US005308226A

United States Patent [19]

Venkatasubbu et al.

[11] Patent Number: 5,308,226

[45] Date of Patent: May 3, 1994

[54] VARIABLE STATOR VANE ASSEMBLY FOR AN AXIAL FLOW COMPRESSOR OF A GAS TURBINE ENGINE

[75] Inventors: Srinivasan Venkatasubbu, Cincinnati; Stephen R. Payling, Fairfield, both of Ohio

[73] Assignee: General Electric Company, Cincinnati, Ohio

[21] Appl. No.: 60,673

[22] Filed: Apr. 23, 1993

Related U.S. Application Data

[63] Continuation of Ser. No. 801,135, Dec. 2, 1991.

[51] Int. Cl.[5] ..... F01B 25/02

[52] U.S. Cl. ..... 415/160; 415/209.3; 415/209.4

[58] Field of Search ..... 415/148, 159, 160, 209.1, 415/209.2, 209.3, 209.4, 210.1, 211.2

[56] References Cited

U.S. PATENT DOCUMENTS

| | | | |
|---|---|---|---|
| 2,809,491 | 10/1957 | Wosika | 415/211.2 |
| 2,819,871 | 1/1958 | McVeigh | 415/209.3 |
| 2,858,062 | 10/1958 | Allen . | |
| 2,930,579 | 3/1960 | Boyd et al. | 415/160 |
| 2,933,235 | 4/1960 | Neumann . | |
| 3,042,370 | 7/1962 | Welsh | 415/209.4 |
| 3,542,484 | 11/1970 | Mason | 415/160 |
| 3,628,922 | 12/1971 | Sprenger | 29/888.025 |
| 3,674,377 | 7/1972 | Trappmann | 415/160 |
| 3,695,777 | 10/1972 | Westphal et al. | 415/209.3 |
| 3,873,168 | 3/1975 | Viola et al. . | |
| 3,999,883 | 12/1976 | Nordenson . | |
| 4,498,790 | 2/1985 | Fisher . | |
| 4,604,030 | 8/1986 | Naudet | 415/160 |
| 4,773,817 | 9/1988 | Stangalini et al. | 415/160 |
| 4,773,821 | 9/1988 | Gonthier et al. | 415/160 |
| 4,890,978 | 1/1990 | McLaurin | 415/209.4 |
| 4,990,056 | 2/1991 | McClain et al. . | |
| 4,995,786 | 2/1991 | Wheeler et al. . | |

FOREIGN PATENT DOCUMENTS

| | | | |
|---|---|---|---|
| 2029859 | 2/1972 | Fed. Rep. of Germany | 415/160 |
| 1227747 | 8/1960 | France | 415/160 |

*Primary Examiner*—Thomas E. Denion

*Attorney, Agent, or Firm*—Jerome C. Squillaro; Charles L. Moore, Jr.

[57] ABSTRACT

A variable angle stator vane assembly for an axial flow gas turbine engine compressor. The compressor casing has a bore surrounded by a boss at the position of each assembly. A housing having a central bore and a bushing assembly is located in the casing bore and is bolted to the boss. The stator vane spindle extends through the housing bore and busing assembly. The housing and bushing assembly can be removed from the casing bore, to be rotated 180° or replaced, without removing the casing from the compressor or the stator vane spindle from the casing bore.

13 Claims, 3 Drawing Sheets

VARIABLE STATOR VANE ASSEMBLY FOR AN AXIAL FLOW COMPRESSOR OF A GAS TURBINE ENGINE

This application is a continuation of application Ser. No. 07/801,135, filed Dec. 2, 1991.

TECHNICAL FIELD

The invention relates to a variable stator vane assembly for a gas turbine engine axial flow compressor, and more particularly to such an assembly wherein the bearing assembly for the stator vane can be rotated axially 180° for prolonged service life and can be removed and replaced from the exterior of the compressor casing without removal of the casing or the stator vane.

BACKGROUND OF THE INVENTION

In the typical gas turbine engine, the axial flow compressor comprises a rotor surrounded by a casing. The casing is generally made in two halves, removably joined together. The rotor is made up of a plurality of stages, each comprising a rotor disc with a single row of blades located on its outer rim. The stages are joined together and to a turbine driven shaft. The casing supports a plurality of stages or annular rows of stator vanes. The stator vane stages are located between the compressor blade stages, helping to compress the air forced through the compressor and directing the air flow into the next stage of rotor blades at the proper angle to provide a smooth, even flow through the compressor.

It has long been known that the use of variable stators to control the amount of air flowing through the compressor will optimize the performance of the compressor throughout the entire operating range of the engine. To this end, selected stator vane stages (generally at the forward portion of the compressor) are provided with variable stator vanes. In the usual prior art practice, at the position of each variable stator vane the casing is provided with an opening or bore surrounded by an exterior boss. The variable stator vane, itself, has a base portion and/or a shaft portion which extends through the bore and is rotatable therein. A bearing assembly is provided in association with the bore to prevent wear of the casing and the stator vane.

Through appropriate testing, a stator schedule is developed which optimizes performance of the compressor, while maintaining acceptable stall margins, throughout the range of operation of the engine. An actuation system is provided to rotate and reposition the stator vanes of each variable stator vane stage according to the stator schedule.

In the usual practice, a circumferentially shiftable unison ring is provided for each variable stage and surrounds the casing. Each variable stator vane of each variable stage has a lever arm operatively connected to its respective unison ring. The unison rings are shifted by an appropriate drive or bell crank mechanism operated by an appropriate actuator, as is well known in the art.

The above-mentioned bushing assemblies, designed to protect each variable stator vane and the adjacent portion of the casing, are, of course, subject to wear. This can lead to metal-to-metal contact between a variable stator vane and the compressor casing. Excessive metal-to-metal contact increases friction in the variable vane system, which in turn can prevent or interfere with movement of the vanes which could result in engine stall. The bushing assembly wears as the variable stator vane is pivoted during engine operation. Some portions of the bushing assembly which are highly loaded tend to wear more than other less highly loaded portions. In prior art structures, unacceptable wear has been detected within from about 6,000 to 10,000 hours of engine operation.

Maintenance to replace the bushing assembly involves removing the compressor casing and tearing down the variable stator vane assembly. This is expensive, time consuming, and requires skilled workers.

The present invention provides a bushing assembly in a metal housing. The bushing assembly is preferably an integral, one-piece bushing, although a multi-piece bushing can be used, as will be described hereinafter. The housing/bushing assembly is bolted to the compressor casing, and can be removed and replaced without opening and removing the casing, and without removing the variable stator vane. As a result, the bushing assembly can be removed and replaced less expensively, more rapidly and requires less skill to perform.

Furthermore, the housing/bushing assembly can be axially rotated 180°. As a consequence, wear on the bushing assembly ca be distributed around the circumference thereof, greatly increasing its service life. It is anticipated that bushing assembly life can be extended to about 25,000 hours.

SUMMARY OF THE INVENTION

According to the invention there is provided a variable angle stator vane assembly for use in an axial flow gas turbine engine compressor having a rotor surrounded by a casing. The rotor provides a plurality of stages of rotating compressor blades and the casing mounts a plurality of stages of stator vanes located between the stages of rotor blades. Selected stages of stator vanes are provided with variable angle stator vane assemblies to adjustably direct air flow to the adjacent compressor blade stage. At the position of each variable angle stator vane assembly, the compressor casing is provided with a bore surrounded on the exterior of the casing by an outwardly extending boss. A cylindrical housing is located within the casing bore. The housing has an inner end and an outer end. The housing outer end is provided with a lateral flange overlying and bolted to the casing boss. The housing has a bore coaxial with the casing bore. The housing bore has a first long portion extending from the housing inner end toward the housing outer end and a second shorter portion extending through said outer end and of larger diameter, forming a shoulder between the first and second bore portions. The housing supports a busing assembly having a central cylindrical journal bearing portion within said first bore portion. Said bushing assembly having a first thrust bearing portion overlying the inner end of said housing. Said bushing assembly having a second thrust bearing portion overlying the housing shoulder.

The variable stator vane has a base portion abutting the first thrust bearing portion of the bushing assembly. The variable stator vane has a spindle portion rotatively received and extending through the journal bearing portion of the bushing assembly.

The spindle extends through a central perforation in a circular spacer having a diameter such that the spacer is received in the larger diameter outer portion of the housing bore. The spindle also passes through a cylindrical alignment sleeve. The outermost end of the shaft is threaded and the assembly is held together by a hex nut threadedly engaged on the vane shaft. The hex nut abuts the alignment sleeve and causes the spacer to bear against the outer thrust bearing portion of the bushing assembly. The variable stator vane shaft also passes through an opening in one end of a lever arm which overlies the hex nut and which is held in place by an additional nut threadedly engaged on the shaft. Means are provided to render the lever arm non-rotatable with respect to the spindle.

From the above description it will be apparent that upon removal of the second nut, the lever arm, the hex nut, the alignment sleeve and the spacer, the bearing assembly housing can be unbolted from the casing boss and either rotated 180° or removed and replaced, depending upon the condition of the bearing assembly. Turning or replacement of the bearing assembly housing can be accomplished from the exterior of the compressor casing without removal of the compressor casing or the variable stator vane.

BRIEF DESCRIPTION OF THE DRAWINGS

While the specification concludes with claims particularly pointing and distinctly claiming the present invention, it is believed the same will be better understood from the following description taken in conjunction with the accompanying drawings in which:

DETAILED DESCRIPTION OF THE INVENTION

Figure 1:
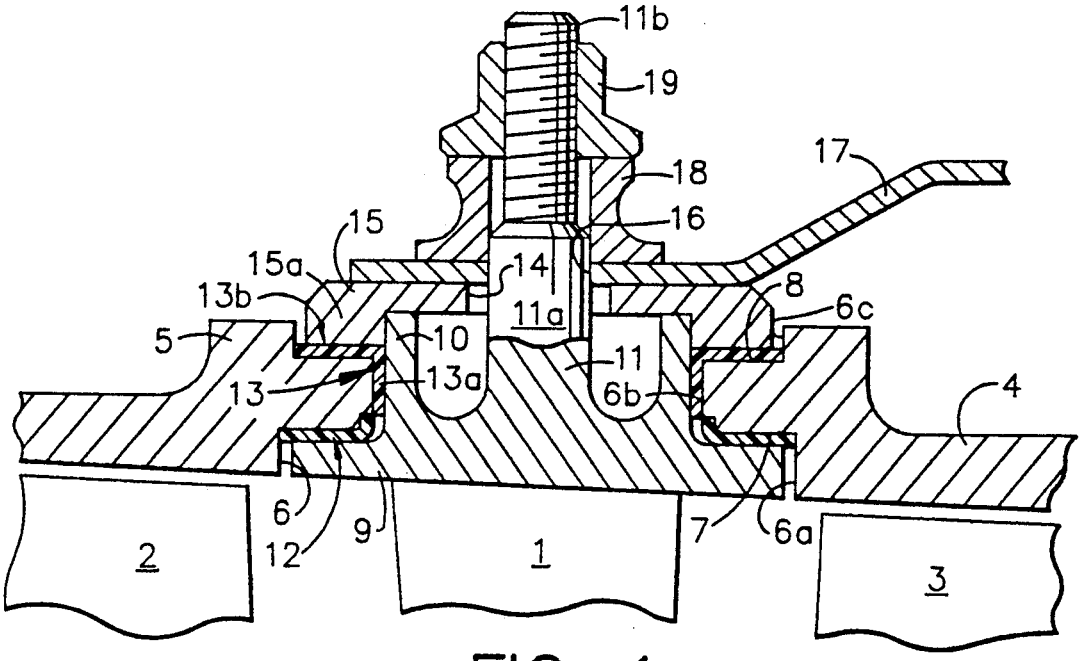
FIG. 1 (PRIOR ART)
FIG. 1 is a fragmentary cross-sectional elevational view of an exemplary prior art variable stator vane assembly.

Referring now to the drawings, wherein like numerals indicate the same elements throughout the views, FIG. 1 illustrates an exemplary prior art variable stator vane assembly. In FIG. 1 the stator vane is indicated at 1 and is shown located between a pair of compressor blades 2 and 3 representing adjacent compressor stages. The compressor casing is illustrated at 4 and is provided with an outwardly extending boss 5. The compressor casing is provided with a bore 6 having an inner portion 6*a*, an intermediate portion 6*b* of lesser diameter, and an outer portion 6*c* having a diameter greater than the portion 6*b* and slightly less than the portion 6*a*. An annular shoulder 7 is formed between bore portions 6*a* and 6*b*. A second annular shoulder 8 is formed between bore portions 6*b* and 6*c*.

The variable stator vane 1 has a base 9 provided with an annular portion 10 and a central spindle 11. The spindle 11 has a first portion 11*a* terminating in a second threaded portion 11*b* of lesser diameter.

The base portion 9, annular portion 10 and spindle 11 extend into and through the casing bore 6. A composite thrust washer 12 is located between the base 9 and the annular shoulder 7. A composite bushing 13 is also provided. The composite bushing 13 has a cylindrical journal bearing portion 13*a* located between the bore portion 6*b* and the annular portion 10 of the variable stator blade base 9. The bushing 13 also has an annular thrust washer portion 13*b* overlying the shoulder 8.

The stator vane spindle portion 11*a* extends through a perforation 14 in a spacer 15. The spacer 15 has a circular peripheral configuration and a depending outer rim portion 15*a* which faces the portion 13*b* of bushing 13.

The portion 11*a* of spindle 11 also passes through a perforation 16 through one end of a lever arm 17. Spindle portion 11*a* has a flat formed thereon (not shown) and the perforation 16 is correspondingly configured, so that the lever arm 17 is non-rotatable with respect to the spindle portion 11*a*. The lever arm 17 is operatively connected to the variable stator vane actuation system (not shown) described heretofore. The spindle 11 passes through an alignment sleeve 18 and the assembly thus far described is held together by a nut 19 threadedly engaged on the spindle portion 11*b*. When nut 19 is tightened, the outer end of annular portion 10 abuts spacer 15 assuring a running clearance between the base 9 and the thrust washer 12 as well as between the depending outer rim portion 15*a* of the spacer 15 and the portion 13*b* of bushing 13.

From the above description, it will be apparent that in order to replace the thrust washer 12 and bushing 13, it is necessary to remove the casing 4 from the compressor section of the engine and to remove the variable stator vane base elements 9, 10 and 11 from the casing bore 6.

Figure 2:
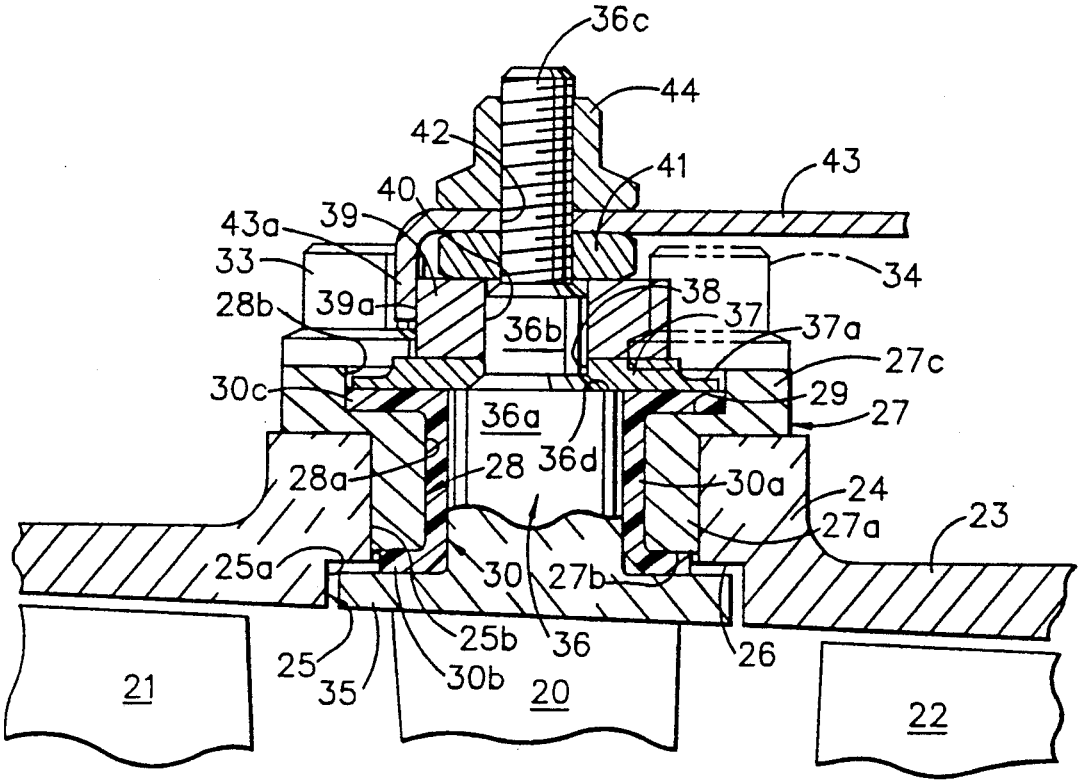
FIG. 2 is a fragmentary, cross-sectional, elevational view of the variable stator vane assembly of the present invention.

Reference is now made to FIG. 2 wherein the variable stator vane assembly of the present invention is illustrated. The variable stator vane is indicated at 20 and is located between a pair of compressor blades 21 and 22, representing adjacent compressor stages.

The compressor casing is illustrated at 23 and is provided with a high, upstanding boss 24. The boss 24 has a rectangular peripheral configuration. A bore 25 is located centrally of the boss. The bore 25 has a first portion 25*a* and a second portion 25*b* of lesser diameter, forming a shoulder 26 therebetween.

Figure 3:
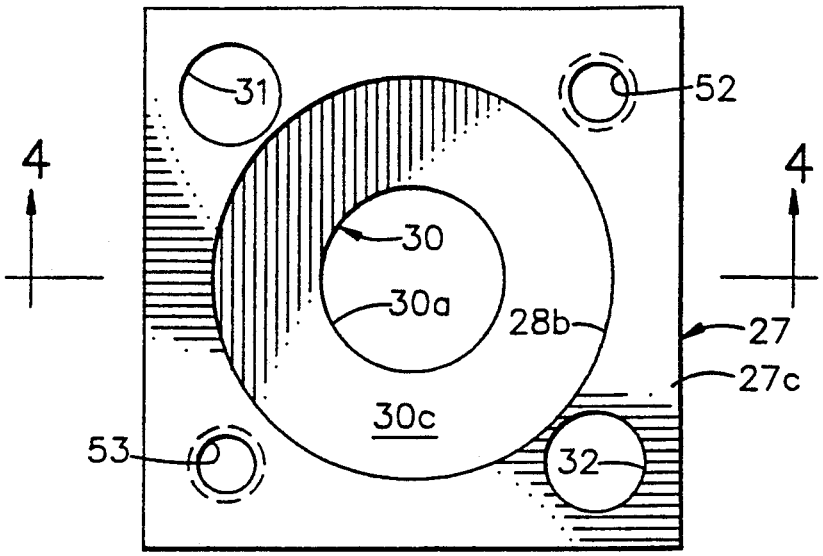
FIG. 3 is a plan view of the bushing assembly and its housing.
Figure 4:
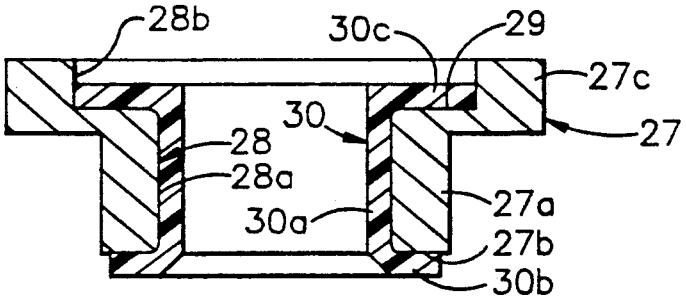
FIG. 4 is a cross-sectional view taken along section line 4—4 of FIG. 3.

The embodiment of FIG. 2 also includes a housing 27. The housing 27 is also shown in FIGS. 3 and 4 The housing 27 is a metal member having a cylindrical body 27*a*. At its inner end, the body 27*a* terminates in a planar, annular bottom surface 27*b*. At its outer end, the body 27*a* is provided with a lateral flange 27*c* having a rectangular peripheral configuration.

The housing 27 has a central bore 28. The bore 28 has a first portion 28*a* and a second portion 28*b* of greater diameter. An annular shoulder 29 is formed between the two bore portions.

The housing 27 supports a bushing assembly 30. The bushing assembly 30 preferably constitutes an integral, one-piece structure and is made of any material appropriate for this use. Excellent results have been obtained using a woven fabric impregnated with resin and formed directly within the housing 27. Under these circumstances, the resin bonds the bushing assembly 30 to the housing 27. The bushing assembly has a journal bearing cylindrical portion 30*a*. The bushing assembly portion 30*a* terminates at its inner end in an annular thrust bearing portion 30*b* overlying the inner end 27*b* of housing 27. The bushing assembly portion 30*a* terminates at its outer end in an annular thrust bearing portion 30c which overlies the housing shoulder 29.

The housing body 27a has an external diameter equivalent to the internal diameter of the casing bore portion 25b and is receivable therein, as is shown in FIG. 2. The flange 27c of housing 27 is adapted to overlie the high boss 24 of the compressor casing 23. The housing flange 27c has a pair of perforations 31 and 32 located in opposite corners thereof. The compressor casing boss 24 is provided with a pair of threaded bores (not shown) coaxial with the flange perforations 31 and 32, respectively. A pair of bolts 33 and 34 extend through the perforations 31 and 32 and threadedly engage in the threaded boss bores (not shown) to secure the housing 27 in its mounted position as shown in FIG. 2. The bolt 34 is shown in phantom lines in FIG. 2 since it would not normally be visible in this figure.

The adjustable stator vane 20 is provided with a base 35 and an upstanding spindle 36. The spindle 36 has a first portion 36a, a second portion 36b of lesser diameter, and a third portion 36c of yet lesser diameter. The third portion 36c is externally threaded, as shown in FIG. 2. A shoulder 36d is formed between spindle portions 36a and 36b. The base 35 of the variable stator vane 20 is receivable with clearance in the bore portion 25a of the casing bore 25. It will be noted that the thrust bearing portion 30b of bushing assembly 30 is located between the variable stator vane base 35 and the inner annular end surface 27b of housing 27. The first spindle portion 36a is of a diameter approximating the internal diameter of the journal bearing portion 30a of bushing assembly 30 and is rotatively received therein.

A disc-like spacer 37 has a peripheral diameter slightly less than the diameter of housing bore portion 28b and is receivable therein, overlying the thrust bearing portion 30c of bearing assembly 30. It will be noted that the periphery of spacer 37 is relieved as at 37a to provide clearance for the heads of bolts 33 and 34. The spacer 37 has a central perforation 38 through which the spindle portion 36b extends with clearance. The spacer 37 is surmounted by an alignment sleeve 39 having a central bore 40, coaxial with the spacer perforation 38. The variable stator vane spindle portion 36b extends into the bore 40 of alignment sleeve 39. Spindle portion 36b has a number of flats (not shown) formed thereon and the alignment sleeve bore 40 is correspondingly configured to render the alignment sleeve non-rotatable with respect to the spindle 36.

The elements thus far described are held in place by a hex nut 41, threadedly engaged on the threaded shaft portion 36c and abutting the alignment sleeve 39. When the hex nut 41 is tightened, the spacer 37 abuts the spindle shoulder 36d assuring a running clearance between the base 35 and bushing portion 30b as well as between the spacer 37 and bearing portion 30c.

The threaded portion 36c of shaft 36 extends through a perforation 42 in a lever arm 43. The alignment sleeve 39 is provided with three peripheral flats, one of which is shown at 39a in FIG. 2. Each of the alignment sleeve flats is engaged by a depending tab on the lever arm 43. One such tab is shown at 43a in FIGS. 2 and 6. A second one of the tabs is shown at 43b in FIG. 6. This arrangement assures that the lever arm 43 is non-rotatable with respect to the alignment sleeve 39. Since the alignment sleeve 39 is non-rotatable with respect to spindle 36, the lever arm 43 is also non-rotatable with respect thereto. The other end of lever arm 43 (not shown) is operatively attached to the variable stator vane actuation system, described above. The lever arm 43 is held in place by a nut 44 threadedly engaged on shaft portion 36c.

Figure 5:
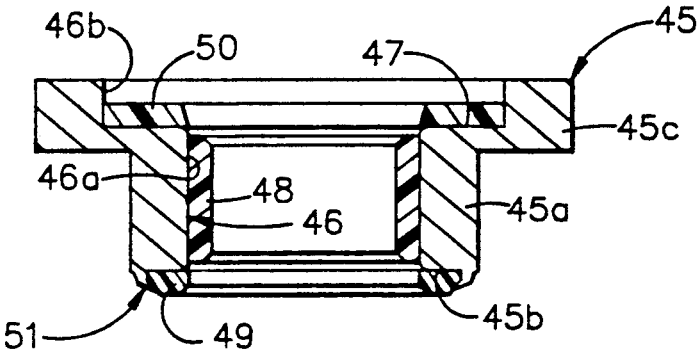
FIG. 5 is a cross-sectional view, similar to FIG. 4, and illustrating an alternate form of bushing assembly.

It would be within the scope of the present invention to provide a multi-piece bearing assembly of any appropriate bearing material such as a carbon composite material, rather than the one-piece bearing assembly 30. This is illustrated in FIG. 5. The housing of FIG. 5 is designated by index numeral 45 and is essentially identical to the housing 27 of FIG. 4. To this end, the housing 45 is a metallic member having a cylindrical body 45a, terminating at its inner end in a planar, annular bottom surface 45b. At its outer end, the body 45a is provided with a lateral flange 45c identical to the flange 27c of FIG. 4. As in the case of the housing 27 of FIG. 4, the housing 45 of FIG. 5 has a central bore 46 having a first portion 46a and a second portion 46b of greater diameter, an annular shoulder 47 being formed therebetween.

In this instance, the bushing assembly comprises a cylindrical journal bearing 48, an inner thrust washer 49 and an outer thrust washer 50. The cylindrical journal bearing 48 and the outer thrust washer 50 are held in place by an interference fit. The inner thrust washer 49 is maintained in place by an annular swaged area 51 about the inner surface 45b of housing 45. Alternatively, the annular swaged area 51 could be replaced by an annular bead of solder or the like. It will be understood by one skilled in the art that the housing 45 and its bushing elements 48, 49 and 50 could be readily substituted in the assembly of FIG. 2 for the housing 27 and the bearing assembly 30.

Figure 6:
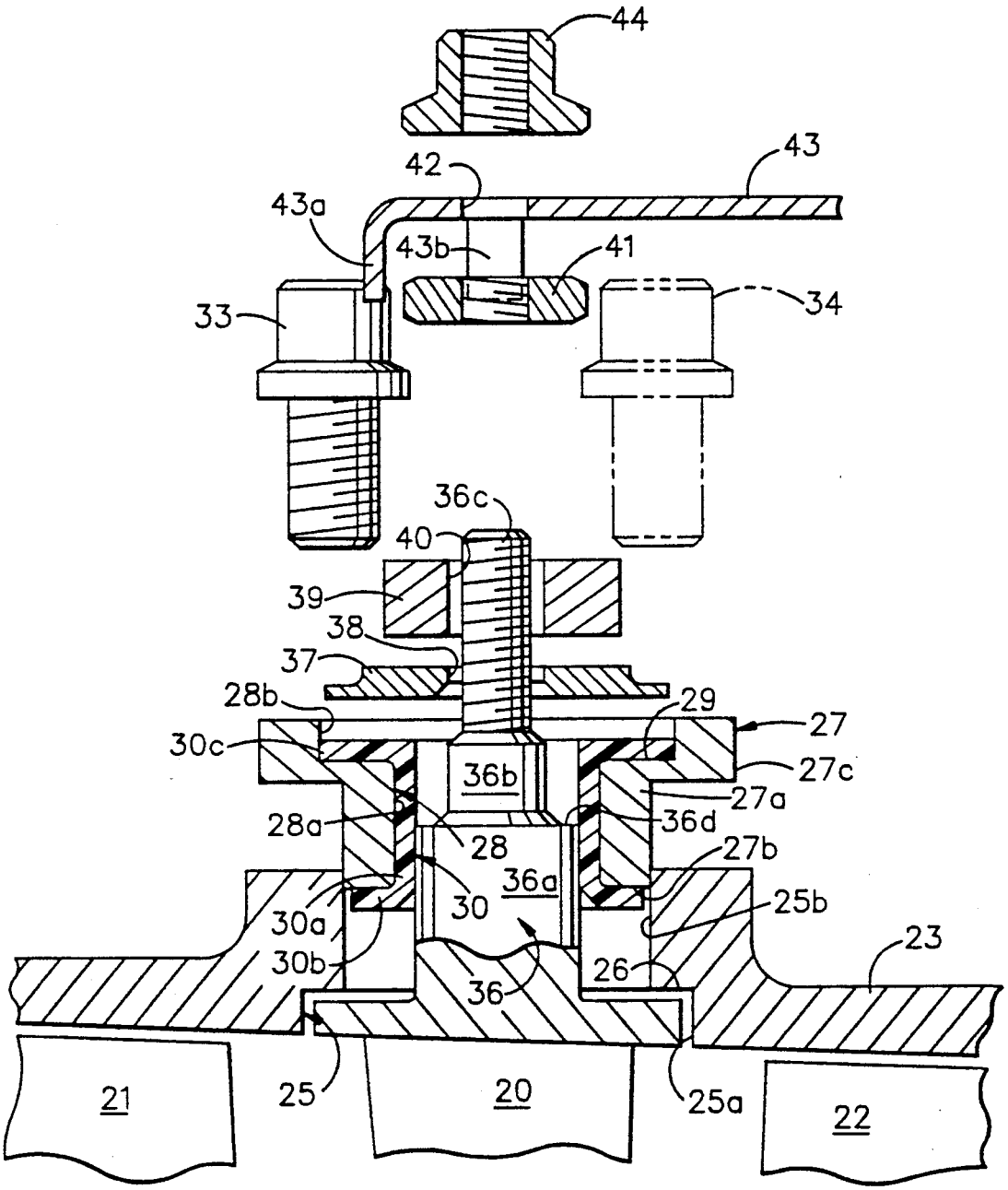
FIG. 6 is a fragmentary, cross-sectional, exploded elevational view of the variable stator vane assembly of FIG. 2.

The invention having been described in detail, the manner in which the housing 27 and its bearing assembly 30 can be rotated 180° or replaced, can now be set forth. Reference is made to FIG. 6 which is an exploded view of the structure of FIG. 2 and wherein like parts have been given like index numerals.

To rotate or remove and replace the housing 27 and bearing assembly 30, the nut 44 is first removed, enabling disengagement of the lever arm 43 from spindle 36 and alignment sleeve 39. Hex nut 41 is thereafter removed from the threaded portion 36c of spindle 36, permitting removal of alignment sleeve 39. At this point, the bolts 33 and 34, affixing housing 27 to boss 24, are removed. The spacer 37 can now be removed, or can simply be removed with the housing 27.

To assist in removal of the housing 27 from the boss bore 25, it is within the scope of the invention to provide the housing flange 27c with a pair of threaded bores 52 and 53 (see FIG. 3). The threaded bores 52 and 53 enable the use of jack screws (not shown) to assist in lifting the housing 27 from the bushing bore 25.

Once the housing 27 has been removed, it can be rotated 180° and repositioned in the boss bore 25, or it and its bushing assembly 30 can be replaced, depending upon the condition of the bushing assembly. Thereafter, the spacer 37 is reinstated and the housing 27 is affixed to the boss 24 by the bolts 33 and 34. The alignment spacer 39 is mounted on spindle 30, followed by hex nut 41. The lever arm 43 is mounted on spindle 36 with its tangs engaged on the flats of alignment sleeve 39 and the nut 44 is again threadedly engaged on the portion 36c of spindle 36.

From the above, it will be apparent that rotation or replacement of the housing 27 and its bushing assembly 30 can be accomplished quickly and easily. Furthermore, rotation or replacement of the housing 27 and bushing assembly 30 can be accomplished from the exterior of the compressor casing 23, without the necessity of removing the compressor casing 23 from the compressor and removing the variable stator vane spindle 36 from the bushing bore 25.

Modifications may be made in the invention without departing from the spirit of it.

What is claimed is:

1. A variable angle stator vane assembly for use in an axial flow compressor of a gas turbine engine having a compressor casing with a bore formed therein at the position of said variable angle stator vane assembly, said variable angle stator vane assembly comprising: an upstanding external boss integrally formed on said casing and surrounding said casing bore, a housing having a central bore, a bushing assembly in said housing, said housing having a body mounted in said casing bore and an integrally formed lateral flange overlying and removably affixed to said external casing boss, said variable angle stator vane having a base terminating in a spindle rotatively mounted in said bushing assembly, said housing and bushing assembly thereof being removable and replaceable from the exterior of said casing without removing said casing from said compressor or said stator vane spindle from said casing bore.

2. The variable angle stator vane assembly claimed in claim 1, wherein said housing is so configured that said housing and said bushing assembly thereof can be removed from said casing bore, rotated axially 180°, and reinstalled in said casing bore from the exterior of said casing without removing said casing from said compressor or said stator vane spindle from said casing bore.

3. The variable angle stator vane assembly claimed in claim 1, wherein said housing body is cylindrical, terminating in an inner, planar, annular end and an outer end surrounded by said housing flange, said housing bore having a first portion extending from said inner end and a second portion leading to said outer end, said second bore portion being of greater diameter than said first bore portion with an annular shoulder formed therebetween, said annular shoulder facing said outer end, said bushing assembly comprising a cylindrical journal bearing portion located in said first bore portion, an inner thrust bearing portion overlying said inner end, and an outer thrust bearing portion overlying said housing shoulder.

4. The variable angle stator vane assembly claimed in claim 3, wherein said bushing assembly comprises an integral, one-piece structure formed within and adhered to said housing.

5. The variable angle stator vane assembly claimed in claim 3, wherein said bushing assembly journal bearing portion and inner and outer thrust bearing portions comprise separate components.

6. The variable angle stator vane assembly claimed in claim 3, wherein said stator vane base faces said bushing assembly inner thrust bearing portion overlying said housing inner end, said stator vane spindle having a first portion extending through said housing bore first portion and said bushing assembly journal bearing portion therein, said spindle first portion terminating in a second portion of lesser diameter than said first portion forming an annular shoulder therebetween, said spindle second portion terminating in a third portion of lesser diameter than said second portion, said third portion being externally threaded, a spacer having a central perforation, said spindle second portion extending through said spacer perforation, said spacer overlying said bushing assembly outer thrust bearing portion and abutting said spindle annular shoulder, an alignment sleeve having a central perforation, said alignment sleeve surrounding said spindle second portion and abutting said spacer, a nut threadedly engaged on said spindle third portion and abutting said alignment sleeve, a stator vane actuating lever arm having a perforation formed therein and being mounted on said spindle third portion abutting said first nut, means rendering said lever arm non-rotatable with respect to said spindle, a second nut threadedly engaged on said spindle third portion and abutting said lever arm, said spindle first portion being of such length as to assure running clearance between said spindle base and said bushing assembly inner thrust bearing portion and between said spacer and said bushing assembly outer thrust bearing portion.

7. The variable angle stator vane assembly claimed in claim 4, wherein said bushing assembly comprises a woven fabric impregnated with resin.

8. The variable angle stator vane assembly claimed in claim 5, wherein said bushing assembly components comprise composite carbon components.

9. The variable angle stator vane assembly claimed in claim 6, wherein said housing is so configured that said housing and said bushing assembly thereof can be removed from said casing bore, rotated axially 180°, and reinstalled in said casing bore from the exterior of said casing without removing said casing from said compressor or said stator vane spindle from said casing bore.

10. The variable angle stator vane assembly claimed in claim 9, wherein said bushing assembly comprises an integral, one-piece structure formed within and adhered to said housing.

11. The variable angle stator vane assembly claimed in claim 9, wherein said bushing assembly journal bearing portion and inner and outer thrust bearing portions comprise separate components.

12. The variable angle stator vane assembly claimed in claim 10, wherein said bushing assembly comprises a woven fabric impregnated with resin.

13. The variable angle stator vane assembly claimed in claim 11, wherein said bushing assembly components comprise composite carbon components.

* * * * *